United States Patent [19]

Taniguchi et al.

[11] Patent Number: 4,511,910

[45] Date of Patent: Apr. 16, 1985

[54] THERMOSENSITIVE RECORDING MATERIAL

[76] Inventors: Keishi Taniguchi, Shizuoka; Kiyotaka Iiyama, Mishima, both of Japan

[21] Appl. No.: 599,408

[22] Filed: Apr. 12, 1984

[30] Foreign Application Priority Data

Apr. 16, 1983 [JP] Japan ..... 58-67520
Oct. 20, 1983 [JP] Japan ..... 58-196798

[51] Int. Cl.[3] ..... B41M 5/18; B41M 5/22

[52] U.S. Cl. ..... 346/216; 346/217; 346/221; 346/225; 427/150; 427/151

[58] Field of Search ..... 346/216, 217, 221, 225, 346/226; 427/150, 151

[56] References Cited

FOREIGN PATENT DOCUMENTS 0039987 3/1982 Japan ..... 346/216
0151394 9/1982 Japan ..... 346/216

*Primary Examiner*—Bruce H. Hess
*Attorney, Agent, or Firm*—Flynn, Thiel, Boutell & Tanis

[57] ABSTRACT

A thermosensitive recording material is disclosed, which comprises a colorless or light-colored coloring material, and a color developer capable of inducing color formation in the colorless or light-colored coloring material upon application of heat thereto, in which the color developer is a phenolic material of the formula

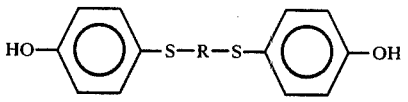

wherein R represents an straight-chain or branched alkylene group having at least one hydroxyl group.

5 Claims, No Drawings

THERMOSENSITIVE RECORDING MATERIAL

BACKGROUND OF THE INVENTION

The present invention relates to a thermosensitive recording material, and more particularly to a thermosensitive recording material capable of forming images with high density and high stability at high speed recording.

In general, a conventional thermosensitive recording material comprises a support material made of, for example, paper or a film, and a thermosensitive coloring layer formed on the support material, which thermosensitive coloring layer comprises a colorless or light colored dyes such as a leuco dye, and a color developer such as a phenolic material (for example, bisphenol A) which is capable of inducing color formation in the colorless or light colored dyes upon application of heat therto, and an acidic material, a binder agent, a filler, a thermosensitivity improvement agent, a lubricating agent and other additives. Examples of such thermosensitive recording material are disclosed, for example, in Japanese Patent Publication No. 43-4160, Japanese Patent Publication No. 45-14039, Japanese Laid-Open Patent Application No. 48-27736 and are widely used in practice.

This thermal recording is attained by a chemical reaction between the colorless or light colored dye and the color developer upon application of heat thereto, for example, by use of a thermal head build-in thermal printer or facsimile apparatus.

As compared with other conventional recording materials, the above described type thermosensitive recording materials have advantages in that recording can be performed by a simple apparatus without requiring complicated steps such as development and image fixing; therefore, such recording is done speedly, quitely, at a low cost and without causing any air pollution problem. Because of these advantages, the thermosensitive recording materials are widely used, for instance, for use with computers, facsimile apparatus, telex, medical measurement instruments and other measuring instruments in a variety of fields.

In accordance with the recent general demand for high speed and highly condensed recording, there is not only a great demand for a high speed thermosensitive recording apparatus, but also a demand for a thermosensitive recording material that is sufficiently compatible with the high speed thermosensitive recording apparatus so as to be capable of attaining high speed and highly condensed recording, in particular, for use in the above-mentioned fields.

Conventionally, thermosensitive recording materials for use in high-speed recording have been proposed, for instance, in Japanese Laid-Open Patent Application No. 53-39139, Japanese Laid-Open Patent Application No. 53-26139, Japanese Laid-Open Patent Application No. 53-5636, and Japanese Laid-Open Patent Application No. 53-11036. In those thermosensitive recording materials, thermo-fusible materials with a low melting point, such as a variety of waxes, fatty acid amides, alkylated biphenyls, substituted biphenyl alkanes, coumarinic acid derivatives, biphenyl amines, are added to the thermosensitive coloring layer as a sensitizer or as an agent for reducing the melting point of the thermosensitive coloring layer. When the above described sensitizer agents are employed, it is necessary that the sensitizer agent be melted prior to the coloring reaction. Therefore, in the high-speed recording by application of a small amount of thermal energy in an extremely short time, for instance, by heat-application impulses, a sufficiently high thermal response for practical use cannot be obtained. In addition to the above problem, in the above case, since the thermo-fusible materials are melted within the thermosensitive coloring layer, the accumulation of the melted thermo-fusible materials on a thermal head during an image recording process, trailing of the printed images and formation of ghost images are apt to occur. Furthermore, at high temperatures and high humidities, fogging also occurs in the background of thermosensitive recording material during storage. As a result, the contrast of the recorded images decreases during storage.

Therefore, it is more preferable not to use the above described sensitizer agents or melting-point reducing agents in the thermosensitive recording materials for use in high speed recording.

Conventional colorless or light-colored dyes which are colored upon application of heat thereto for use in the thermosensitive recording materials, usually melt at high temperatures in the range of 160° C. to 240° C. Therefore, when a thermosensitive coloring layer suitable for high speed recording is prepared without using the above-mentioned sensitizers, it is indispensable to use a color developer with a low melting point and high coloring performance capable of inducing color formation in the colorless or light-colored dyes. The color developers to be used in combination with the colorless or light-colored dyes, in particular, phenolic color developers, are described in many references including Japanese Patent Publication No. 45-14039. Among a large number of phenolic color developers, 2,2-bis(4'-hydroxyphenyl)propane (or Bisphenol A) is preferably used, because of the stability of the quality as the color developer, and the reasonable price and availability. Bisphenol A, however, has the shortcoming that its melting point is as high as 156°–158° C., and its color inducement temperature is high, so that its thermal sensitivity is low.

In contrast to this, in the case where phenolic materials with low melting points, for instance, monohydric phenols, such as 4-t-butylphenol (m.p. 94°–99° C.), $\alpha$-naphthol (m.p. 95°–96° C.), and $\beta$-naphthol (m.p. 119°–122° C.) are employed, the preservability and stability of the thermal recording materials are so poor that the background thereof is fogged and discolored with time at room temperature during storage. and thermal recording materials containing such monophenols have a characteristic phenolic odor and are not suitable for practical use.

In Japanese Patent Publication No. 54-12819 and Japanese Patent Laid-Open Application No. 55-27253, 2,2-bis(4'-hydroxylphenyl)-n-hexane (m.p. 99°–103° C.) and 1,1-bis(4'-hydroxylphenyl)alkane (the alkane having 3 to 13 carbon atoms) are respectively disclosed as having low melting points and being capable of yielding images in a stable manner when they are employed in thermosensitive recording materials. However, these materials are difficult to synthesize and cannot be obtained easily.

In Japanese Laid-Open Publication No. 56-144193, it is described that a lower alkyl ester and a benzyl ester of p-hydroxybenzoic acid can be easily synthesized, and, by use of the esters, thermosensitive recording materials with high sensitivity can be prepared. However, the thermosensitive recording materials using the esters have the shortcomings that the developed colored portions easily discolor and the phenolic materials are separated in the developed image areas in the form of white crystals or powders.

The above-described conventional thermosensitive recording materials utilizing the chemical coloring reaction between a leuco dye and a phenolic material also has the shortcoming that the developed images formed thereon are discolored or disappear, or the density of the images significantly decreases, while in contact with, for instance, oils and polyvinyl chloride film. In the case of polyvinyl chloride film, this occurs possibly due to the plasticizers contained in the polyvinyl chloride film.

In order to eliminate the above shortcoming, there is disclosed a thermosensitive recording material having an overcoat layer comprising a water-soluble polymeric material for protecting the thermosensitive coloring layer thereof. However, since the overcoat layer hinders heat transmission, when the overcoat layer is formed on the thermosensitive coloring layer, its thermosensitivity decreases. Furthermore, the coating process of the overcoat layer makes the recording material expensive.

SUMMARY OF THE INVENTION

It is therefore an object of the present invention to provide an improved thermosensitive recording material which is capable of yielding images with high density and high sharpness with high thermal response in a stable manner in high-speed recording, which images are stable at high temperatures and high humidities.

Another object of the present invention is to provide a thermosensitive recording material which is stable in prolonged storage at room temperature and free from phenolic odor in spite of the use of a highly thermosensitive phenolic material, which phenolic material is readily available and is suitable for practical use.

A further object of the present invention is to provide a thermosensitive recording material which is substantially free from the problems of discoloration and fading of the developed colored images, even if the images come into contact with, for instance, oils and polyvinyl chloride film.

The above objects of the present invention can be attained by using a phenolic material of the following formula as a color developer in a thermosensitive recording material which employs a coloring reaction between a colorless or light-colored leuco dye and a color developer:

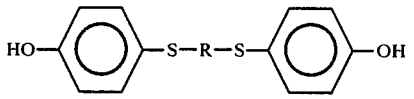

(I)

wherein R represents a straight-chain or branched alkylene group having at least one hydroxyl group.

In the phenolic material of the above formula (I), it is preferable that the alkylene group represented by R have 1 to 8 carbon atoms, and the hydroxyl group be bonded to either the main chain of the alkylene group or the branched chain bonded directly to the main chain of the alkylene group. Further, it is preferable that the number of the hydroxyl groups bonded to the alkylene group be 1 to 3.

As the leuco dye, any conventional leuco dyes can be employed. However, when producing a thermosensitive recording material having high resistance to plasticizers contained, for example, in a polyvinyl chloride film, fluoran compounds of the following formula are particularly preferable:

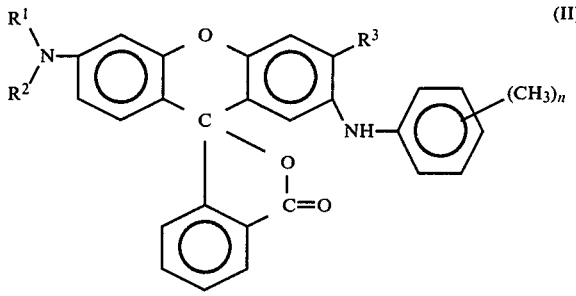

(II)

wherein $R^1$ and $R^2$ each represent an alkyl group having 1 to 6 carbon atoms; $R^3$ represents an alkyl group having 1 to 2 carbon atoms; and n is an integer of 0 or 1.

DETAILED DESCRIPTION OF THE PREFERRED EMBODIMENTS

Examples of the phenolic compounds of the previously described formula (I) employed as the color developers in the present invention are as follows:

| Compound No. | Structural Formula |
|---|---|
| (1) | 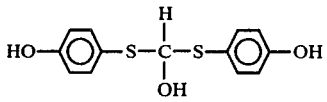 |
| (2) | 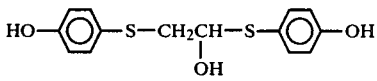 |
| (3) | 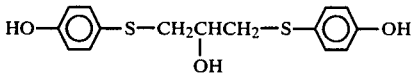 |
| (4) | 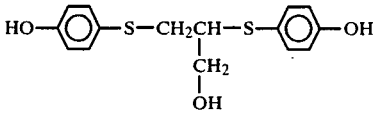 |
| (5) | 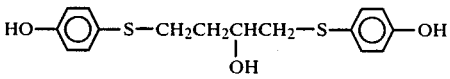 |
| (6) | 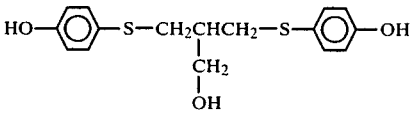 |
| (7) | 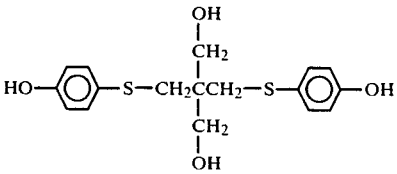 |

-continued

| Compound No. | Structural Formula |
|---|---|
| (8) | 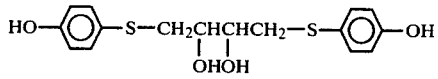 |
| (9) | 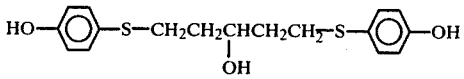 |
| (10) | 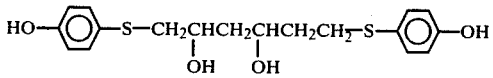 |
| (11) | 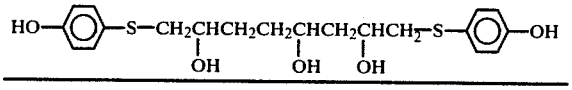 |

The above phenolic compounds can be used in combination with conventional phenolic materials when necessary.

The colorless or light-colored leuco dyes to be used in combination with the above phenolic compounds are, for example, as follows:

Crystal Violet Lactone,
3-diethylamino-6-methyl-7-(o,p-dimethylanilino)fluoran,
3-(N-ethyl-p-toluidino)-6-methyl-7-anilinofluoran,
3-(1-pyrrolidinyl)-6-methyl-7-anilinofluoran,
3-piperidino-6-methyl-7-anilinofluran,
3-(N-cyclohexyl-N-methylamino)-6-methyl-7-anilinofluoran,
3-diethylamino-7-(o-chloroanilino)fluoran,
3-diethylamino-7-(m-trifluoromethylanilino)fluoran,
3-diethylamino-6-methyl-7-chlorofluoran,
3-diethylamino-6-methylfluoran, and
3-cyclohexylamino-6-chlorofluoran.

Examples of the fluoran compounds of the general formula (II) are as follows:

3-diethylamino-6-methyl-7-anilinofluoran,
3-(N-ethyl-N-isoamylamino)-6-methyl-7-anilinofluoran,
3-(N-methyl-N-n-hexylamino)-6-methyl-7-anilinofluoran,
3-diethylamino-6-ethyl-7-(4'-methylanilino)fluoran.

The above leuco dyes can be used alone or in combination.

It is preferable that the phenolic materials of the formula (I) for use in the present invention be employed in an amount of 1 to 6 times the amount of the leuco dye.

In the thermosensitive coloring layer of a thermosensitive recording material according to the present invention, the following binder agents can be employed: water-soluble organic polymers such as polyvinyl alcohol, methoxy cellulose, hydroxyethyl cellulose, carboxymethyl cellulose, polyvinyl pyrrolidone, polyacrylamide, polyacrylic acid, starch and gelatin; and water emulsions of polystyrene, copolymer of vinyl chloride and vinyl acetate, and polybutyl methacrylate.

Furthermore, in the thermosensitive coloring layer, the following additives can be contained in the form of fine powder to obtain clear images: calcium carbonate, silica, barium sulfate and aluminum stearate.

In order to increase the thermal sensitivity of the recording material, a variety of conventional thermofusible materials can also be employed. As the thermofusible materials, organic low-molecular-weight compounds, oligomers and polymers having appropriate melting or softening points can be employed. Specific examples of such organic materials are animal waxes, vegetable waxes, mineral waxes, petroleum waxes and other synthesized waxes such as higher fatty acids, higher fatty amine, higher fatty acid amides, phenyl benzoate derivatives, crystalline alkylnaphthalenes, crystalline alkyldiphenyl derivatives and alkylphenyl derivatives.

The thermosensitive recording material according to the present invention can be prepared with a variety of structures, including all the conventional structures in which the coloring reaction between a leuco dye and a color developer is employed. For instance, in the thermosensitive recording material according to the present invention, a leuco dye and the color developer can be supported on the same support material or they can be supported separately on two different support materials.

In the case where a leuco dye and a color developer are supported on the same support material, a thermosensitive coloring layer comprising the leuco dye and the color developer is formed on the support material, with addition of a binder agent thereto, or a thermosensitive coloring layer comprising two layers, with the leuco dye contained in one layer, and the color developer contained in the other layer.

In the case where a leuco dye and the color developer are separately supported on the support materials, those support materials are superimposed on each other in such a manner that the surface of one support material which bears the leuco dye and the surface of the other support material which bears the color developer come into contact with each other when thermal printing is performed. Thereafter, the two support materials are separated, whereby color images are obtained in one support material. In other words, the present invention can be applied to any conventional thermosensitive recording materials which utilize the coloring reaction between a leuco dye and a color developer.

The thermosensitive recording according to the present invention can also be used as a thermal-image-transfer-type thermosensitive recording material which comprises an image transfer sheet consisting of a support material and an image transfer layer formed on the support material, containing a leuco dye, and an image acceptor sheet consisting of a support material and an image acceptor layer formed on the support material, containing the color developer.

In the case of the thermal-image-transfer-type recording material, the image transfer sheet is superimposed on the image acceptor sheet in such a manner that the image acceptor layer comes into contact with the image transfer layer of the image transfer sheet, so that thermal printing is performed on the front side or back side of the superimposed sheets, whereby the desired developed images are formed on the image acceptor layer of the acceptor sheet.

The thermosensitive recording material according to the present invention can be prepared, for example, by application of a thermosensitive coloring layer formation liquid containing the above described components to a support material, for example, paper, synthetic paper or a plastic film, and by drying the same. When the leuco dye and the color developer are supported on two separate support materials, a leuco dye dispersion or solution and a color developer dispersion or solution are applied to each support material.

The thermosensitive recording material according to the present invention can be employed in a wide variety of fields, particularly advantageously in the fields of thermosensitive recording label sheets and thermosensitive recording type magnetic tickets, utilizing the excellent stability of the developed images.

When the thermosensitive recording material is employed as the thermosensitive recording label sheet, there is formed a thermosensitive coloring layer comprising one of the previously mentioned leuco dyes and one of the phenolic materials on one side of a support material, and on the other side of the support material, there is formed an adhesive layer, and a disposable backing sheet is attached to the adhesive layer.

When the thermosensitive recording material is employed as the thermosensitive recording type magnetic ticket, the disposable backing sheet in the label sheet is replaced with a magnetic recording layer comprising as the main components a ferromagnetic material and a binder agent.

The phenolic compounds of the previously described general formula (I) can be prepared without difficulty. For example, the compound No. 3 of the following formula was prepared as follows:

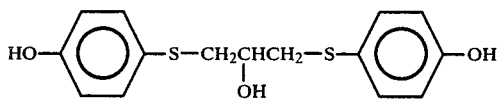

6.4 g of sodium hydroxide was dissolved in 22 g of methanol. To this solution, 20.2 g of p-hydroxybenzenethiol was added. Further, 9.42 g of 2-hydroxy-1,3-dichloropropane was added dropwise to this mixture at room temperature.

After the addition of the 2-hydroxy-1,3-dichloropropane, the reaction mixture was heated for 2 hours under the condition that the methanol contained in the reaction mixture was refluxed. After this, the reaction mixture was cooled and freed of the methanol under reduced pressure. To the residue was added 500 ml of water. Crystals were separated, which were filtered off, sufficiently washed with water and dried.

The thus obtained crystals were recrystallized from a mixed solvent of toluene and ethyl acetate, so that 15.5 g of 1,3-di(4'-hydroxyphenylthio)-2-hydroxypropane (Compound No. 3) was obtained in the form of white crystals (m.p. 108°-109° C.).

The results of the elemental analysis of the product, 1,3-di(4-hydroxyphenylthio)-2-hydroxypropane, were as follows:

| | % C | % H | % S |
|---|---|---|---|
| Found | 58.51 | 5.18 | 20.68 |
| Calculated | 58.42 | 5.23 | 20.79 |

Embodiments of the thermosensitive recording material according to the present invention will now be explained by referring to the following examples.

EXAMPLE 1

A dispersion A-1, a dispersion B-1 and a dispersion C-1 were separately prepared by grinding and dispersing the following respective components in a ceramic bowl for 2 days:

| | Parts by Weight |
|---|---|
| Dispersion A-1 | |
| 3-(N—cyclohexyl-N—methylamino)-6-methyl-7-anilinofluoran | 20 |
| 10% aqueous solution of hydroxyethyl cellulose | 20 |
| Water | 60 |
| Dispersion B-1 | |
| 1,3-di(4'-hydroxyphenylthio)-2-hydroxypropane (Compound No. 3) | 20 |
| 10% aqueous solution of hydroxyethyl cellulose | 20 |
| Water | 60 |
| Dispersion C-1 | |
| Calcium carbonate | 20 |
| 5% aqueous solution of methyl cellulose | 20 |
| Water | 60 |

10 parts by weight of the dispersion A-1, 30 parts by weight of the dispersion B-1, 30 parts by weight of the dispersion C-1 and 10 parts by weight of a 20% aqueous alkali solution of isobutylene—maleic anhydride were mixed to prepare a thermosensitive coloring layer formation liquid.

This thermosensitive coloring layer formation liquid was applied to the surface of a sheet of commercially available high quality paper (50 g/m$^2$) by a wire bar and was then dried, whereby a thermosensitive coloring layer was formed thereon. The deposition of the thermosensitive coloring layer on the sheet was in the range of 4 to 5 g/m$^2$ when dried. The thus prepared thermosensitive recording material was subjected to calendering, so that surface of the thermosensitive coloring layer was made smooth to the degree ranging from 500 to 600 sec in terms of Bekk's smoothness, whereby a thermosensitive recording material No. 1 according to the present invention was prepared.

EXAMPLE 2

Example 1 was repeated except that the dispersion B-1 employed in Example 1 was replaced by a dispersion B-2 with the following formulation, whereby a thermosensitive recording material No. 2 according to the present invention was prepared.

| | Parts by Weight |
|---|---|
| Dispersion B-2 | |
| 1,6-di(4'-hydroxyphenylthio)-2,4-dihydroxyhexane (Compound No. 10) | 20 |
| 10% aqueous solution of hydroxyethyl cellulose | 20 |
| Water | 60 |

EXAMPLE 3

Example 1 was repeated except that the dispersion B-1 employed in Example 1 was replaced by a dispersion B-3 with the following formulation, whereby a thermosensitive recording material No. 3 according to the present invention was prepared.

| | Parts by Weight |
|---|---|
| Dispersion B-3 | |
| 1,4-di(4'-hydroxyphenylthio)-2,3-dihydroxybutane (Compound No. 8) | 20 |

-continued

| | Parts by Weight |
|---|---|
| 10% aqueous solution of hydroxyethyl cellulose | 20 |
| Water | 60 |

COMPARATIVE EXAMPLE 1

Example 1 was repeated except that the dispersion B-1 employed in Example 1 was replaced by a comparative dispersion CB-1 with the following formulation, whereby a comparative thermosensitive recording material No. 1 was prepared.

| | Parts by Weight |
|---|---|
| Comparative Dispersion CB-1 | |
| Bisphenol A | 20 |
| 10% aqueous solution of hydroxyethyl cellulose | 20 |
| Water | 60 |

COMPARATIVE EXAMPLE 2

Example 1 was repeated except that the dispersion B-1 employed in Example 1 was replaced by a comparative dispersion CB-2 with the following formulation, whereby comparative thermosensitive recording material No. 2 was prepared.

| | Parts by Weight |
|---|---|
| Comparative Dispersion CB-2 | |
| p-Hydroxybenzoic acid benzyl ester | 20 |
| 10% aqueous solution of hydroxyethyl cellulose | 20 |
| Water | 60 |

The thus prepared thermosensitive recording materials No. 1 through 3 according to the present invention and the comparative thermosensitive recording materials No. 1 and No. 2 were subjected to thermal printing by use of a thermal printing test apparatus including thermal head (made by Matsushita Electronic Components Co., Ltd.) under the conditions that the power applied to the head was 0.45 W/dot, the recording time per line was 20 msec, the scanning line density was 8×3.85 dots/mm, with the pulse width applied thereto changed to 3 steps of 1.6 msec, 2.0 msec, and 2.4 msec. The density of the developed images was measured by Macbeth densitometer RD-514 with a filter W-106. The results are shown in the following Table 1.

TABLE 1

| | Thermosensitive Recording Material | Developed Image Density Pulse width (msec) 1.6 | 2.0 | 2.4 | Background Density |
|---|---|---|---|---|---|
| Example 1 | No. 1 | 0.94 | 1.25 | 1.28 | 0.10 |
| Example 2 | No. 2 | 0.92 | 1.22 | 1.27 | 0.09 |
| Example 3 | No. 3 | 0.92 | 1.23 | 1.27 | 0.10 |
| Comparative Example 1 | No. 1 | 0.40 | 0.74 | 1.05 | 0.09 |
| Comparative Example 2 | No. 2 | 0.90 | 1.21 | 1.27 | 0.08 |

The thermosensitive recording materials with images printed thereon under the condition of the pulse width being 2.4 msec were allowed to stand at room temperature for one week and the image densities were measured again by the Macbeth densitometer RD-514 and were visually checked whether or not crystals (or powder) of the phenolic material were separated on the surface of the recording materials. The results are shown in Table 2.

TABLE 2

| | Thermosensitive Recording Material | Image Density after 1 week | Separation of Phenolic Material |
|---|---|---|---|
| Example 1 | No. 1 | 1.29 | None |
| Example 2 | No. 2 | 1.28 | None |
| Example 3 | No. 3 | 1.29 | None |
| Comparative Example 1 | No. 1 | 1.03 | None |
| Comparative Example 2 | No. 2 | 0.95 | Observed |

The thermal recording materials No. 1 through No. 3 according to the present invention and the comparative thermal recording materials No. 1 and No. 2 were subjected to thermal printing tests by use of a heat gradient test apparatus (made by Toyo Seiki Co., Ltd.) at 150° C. with a pressure of 2 kg/cm$^2$ and with a heat application time of 1 second, so that printed images were formed on each of the thermosensitive recording materials. To the printed images on the thermosensitive recording materials, there was applied cotton seed oil, and the recording materials were then allowed to stand for 24 hours to see whether or not the images were discolored or caused to disappear by the oil. The results are shown in the following Table 3.

TABLE 3

| | Thermosensitive Recording Material | Discoloration or Disappearance of Images |
|---|---|---|
| Example 1 | No. 1 | Substantially no discoloration |
| Example 2 | No. 2 | Substantially no discoloration |
| Example 3 | No. 3 | Substantially no discoloration |
| Comparative Example 1 | No. 1 | Disappeared |
| Comparative Example 2 | No. 2 | Disappeared |

As can be seen from the above results, the thermosensitive recording materials according to the present invention are excellent in development performance in high-speed recording and provided images free from the white crystallization of the phenolic materials and discoloration by the oil and stabler in quality as compared with the comparative thermosensitive recording material examples.

EXAMPLE 4

A dispersion A-2, a dispersion B-1 and a dispersion C-1 were separately prepared by grinding and dispersing the following respective components in a ceramic bowl for 2 days:

| | Parts by Weight |
|---|---|
| Dispersion A-2 | |
| 3-diethylamino-6-methyl-7-anilinofluoran | 20 |
| 10% aqueous solution of hydroxyethyl cellulose | 20 |
| Water | 60 |

-continued

| | Parts by Weight |
|---|---|
| Dispersion B-1 | |
| 1,3-di(4'-hydroxyphenylthio)-2-hydroxy-propane (Compound No. 3) | 20 |
| 10% aqueous solution of hydroxyethyl cellulose | 20 |
| Water | 60 |
| Dispersion C-1 | |
| Calcium carbonate | 20 |
| 5% aqueous solution of methyl cellulose | 20 |
| Water | 60 |

10 parts by weight of the dispersion A-2, 30 parts by weight of the dispersion B-1, 30 parts by weight of the dispersion C-1 and 10 parts by weight of a 20% aqueous alkali solution of isobutylene—maleic anhydride were mixed to prepare a thermosensitive coloring layer formation liquid.

This thermosensitive coloring layer formation liquid was applied to the surface of a sheet of commercially available high quality paper (50 g/m$^2$) by a wire bar and was then dried, whereby a thermosensitive coloring layer was formed thereon. The deposition of the thermosensitive coloring layer on the sheet was in the range of 4 to 5 g/m$^2$ when dried. The thus prepared thermosensitive recording material was subjected to calendering, so that surface of the thermosensitive coloring layer was made smooth to the degree ranging from 500 to 600 sec. in terms of Bekk's smoothness, whereby a thermosensitive recording material No. 4 according to the present invention was prepared.

EXAMPLE 5

Example 4 was repeated except that the dispersion A-2 employed in Example 4 was replaced by a dispersion A-3 with the following formulation, whereby a thermosensitive recording material No. 5 according to the present invention was prepared.

| | Parts by Weight |
|---|---|
| Dispersion A-3 | |
| 3-(N—ethyl-N—isoamylamino)-6-methyl-7-anilinofluoran | 20 |
| 10% aqueous solution of hydroxyethyl cellulose | 20 |
| Water | 60 |

EXAMPLE 6

Example 4 was repeated except that the dispersion A-2 employed in Example 4 was replaced by a dispersion A-4 with the following formulation, whereby a thermosensitive recording material No. 6 according to the present invention was prepared.

| | Parts by Weight |
|---|---|
| Dispersion A-4 | |
| 3(N—methyl-N—n-hexylamino)-6-methyl-7-anilinofluoran | 20 |
| 10% aqueous solution of hydroxyethyl cellulose | 20 |
| Water | 60 |

EXAMPLE 7

Example 4 was repeated except that the dispersion A-2 employed in Example 4 was replaced by a dispersion A-5 with the following formulation, whereby a thermosensitive recording material No. 7 according to the present invention was prepared.

| | Parts by Weight |
|---|---|
| Dispersion A-5 | |
| 3-di-n-butylamino-7-(o-chloroanilino)-fluoran | 20 |
| 10% aqueous solution of hydroxyethyl cellulose | 20 |
| Water | 60 |

EXAMPLE 8

Example 4 was repeated except that the dispersion A-2 employed in Example 4 was replaced by a dispersion A-6 with the following formulation, whereby a thermosensitive recording material No. 8 according to the present invention was prepared.

| | Parts by Weight |
|---|---|
| Dispersion A-6 | |
| 3-(N—ethyl-N—p-toluidino)-6-methyl-7-anilinofluoran | 20 |
| 10% aqueous solution of hydroxyethyl cellulose | 20 |
| Water | 60 |

COMPARATIVE EXAMPLE 3

Example 4 was repeated except that the dispersion B-1 employed in Example 4 was replaced by a comparative dispersion CB-1 with the following formulation, whereby a comparative thermosensitive recording material No. 3 was prepared.

| | Parts by Weight |
|---|---|
| Comparative Dispersion CB-1 | |
| Bisphenol A | 20 |
| 10% aqueous solution of hydroxyethyl cellulose | 20 |
| Water | 60 |

The thus prepared thermosensitive recording materials No. 4 through 8 according to the present invention and the comparative thermosensitive recording material No. 3 were subjected to thermal printing tests by use of the heat gradient test apparatus (made by Toyo Seiki Co., Ltd.) at 150° C. with a pressure of 2 kg/cm$^2$ and with a heat application time of 1 second, so that printed images were formed on each of the thermosensitive recording materials. To the printed-images-bearing thermosensitive recording materials, there was applied cotton seed oil, and the recording materials were then allowed to stand for 24 hours to see whether or not the images and the background thereof were discolored or caused to disappear by the oil.

The results were that in the thermosensitive recording materials No. 4 through No. 8, the image areas were not discolored, and the background areas were not colored. In contrast to this, in the comparative thermosensitive recording material No. 3, the background areas were not colored, but the image areas faded.

The thermosensitive recording materials No. 4 through No. 8 according to the present invention and the comparative recording material No. 3 were subjected to thermal printing by use of a thermal printing test apparatus including a thermal head (made by Matsushita Electronic Components Co., Ltd.) under the conditions that the power applied to the head was 0.45 W/dot, the recording time per line was 20 msec, the scanning line density was 8×3.85 dots/mm, with the pulse width applied thereto being 2.4 msec. The density of the developed images was measured by a Macbeth densitometer RD-514. Samples of the above thermosensitive recording materials with a size of 4 $cm^2$ were made so as to include image areas in the central portion thereof and were laid on a polyvinyl chloride film (Poly Wrapper V-300 made by The Shin-Etsu Chemical Industry Co., Ltd.) with a load of 500 $g/m^2$ applied at room temperature for 24 hours. Thereafter, the densities of the image areas of those samples was measured by a Macbeth densitometer RD-514, so that the image densities of the samples before the above polyvinyl chloride film test and after the test were compared. The results were as shown in the following Table 4.

TABLE 4

| | Thermosensitive Recording Material | Polyvinyl Chloride Film Test | |
|---|---|---|---|
| | | Image Density before Test | Image Density after Test |
| Example 4 | No. 4 | 1.35 | 1.21 |
| Example 5 | No. 5 | 1.35 | 1.12 |
| Example 6 | No. 6 | 1.36 | 1.14 |
| Example 7 | No. 7 | 1.29 | 0.41 |
| Example 8 | No. 8 | 1.35 | 0.49 |
| Comparative Example 3 | No. 3 | 1.29 | 0.30 |

In the thermosensitive recording materials No. 4 through No. 6 in Examples 4 to 6, as the leuco dyes, the fluoran compounds of the previously described formula (II) were employed, while in the thermosensitive recording materials No. 7 and No. 8, other fluoran compounds which were not covered by the formula (II) were employed. From the above results, it can be seen that the thermosensitive recording materials employing the fluoran compounds of the formula (II) yielded images which were more resistant to the polyvinyl chloride film than the images provided by the thermosensitive recording materials containing other fluoran compounds.

According to the present invention, by use of the above described phenolic materials, thermosensitive recording materials with the following advantages over the conventional thermosensitive recording materials can be obtained:

(1) High thermal sensitivity (i.e. high thermal response) is obtained, since no sensitizers or melting-point reducing agents are employed. Due to the high thermal response, images can be recorded with high density and clearness in high speed recording.

(2) Since no sensitizers or melting-point reducing agents are employed, printed images do not substantially discolor with time, and high image contrast can be maintained. In other words, the quality of printed images is very stable.

(3) Since no sensitizers or melting point reducing agents are employed, no components come out from the thermosensitive recording material and accumulate on or adhere to a thermal head during thermal printing by use of a thermal printer with a thermal head, and no troubles such as trailing of images and ghost images take place, thereby attaining high recording performance.

(4) By use of the phenolic compounds of the previously described formula (I), no fogging of the developed images takes place at room temperature, and there is no problem of an unpleasant phenolic odor as in other conventional phenolic compounds. Thus, the recording materials according to the present invention are useful in practice.

(5) The phenolic materials employed in the present invention as the color developer are readily available since they can be synthesized with higher yield and higher purity and at a comparatively lower cost, as compared with the conventional color developers.

(6) By use of the phenolic compounds of the previously described formula (I), it does not occur that printed images discolor with time and components contained in the thermosensitive recording material separated out in the form of white crystals on the surface thereof during storage. Thus, the printed images are very stable in quality.

(7) By use of the phenolic compounds of the previously described formula (I), the printed images are resistant to finger prints, oils and plasticizers contained, for instance, in polyvinyl chloride film, thereby yielding thermosensitive recording materials with excellent and stable image quality.

(8) By applying a thermosensitive coloring layer formation liquid prepared in accordance with the present invention to a sheet of thin base paper or to a film, an excellent thermosensitive copy sheet for use with an infrared lamp or a storobo flash can be prepared.

(9) Since the coating amount of the thermosensitive coloring layer formation liquid can be reduced, in comparison with the conventional thermosensitive recording materials, the manufacturing efficiency of the thermosensitive recording materials according to the present invention can be significantly increased as compared with the manufacturing efficiency of the conventional thermosensitive recording materials.

What is claimed is:

1. In a thermosensitive recording material comprising a colorless or light-colored coloring material, and a color developer capable of inducing color formation in said colorless or light-colored coloring material upon application of heat thereto, the improvement wherein said color developer is a phenolic material of the formula

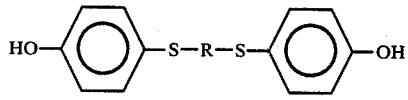

wherein R represents an straight-chain or branched alkylene group having at least one hydroxyl group.

2. A therosensitive recording material as claimed in claim 1, wherein said colorless or light-colored coloring material is a fluoran compound of the formula

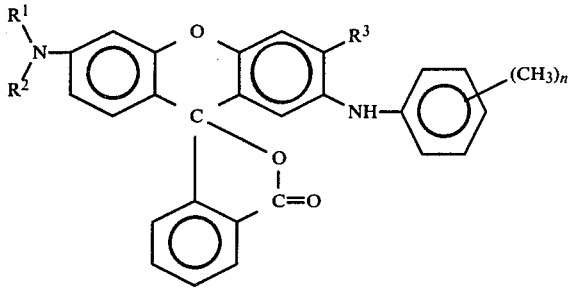

wherein $R^1$ and $R^2$ each represent an alkyl group having 1 to 6 carbon atoms; $R^3$ represents an alkyl group having 1 to 2 carbon atoms; and n is an integer of 0 or 1.

3. A thermosensitive recording material as claimed in claim 1, wherein said colorless or light-colored coloring material and said color developer are contained, together with a binder agent, in a thermosensitive recording layer formed on a support material.

4. A thermosensitive recording material as claimed in claim 1, wherein said colorless or light-colored coloring material is supported by a first binder agent on a first support material; and said color developer is supported by a second binder agent on a second support material.

5. A thermosensitive recording material as claimed in claim 1, wherein the amount of said color developer is 1 to 6 times the amount of said colorless or light-colored coloring material.

* * * * *